US005165429A

United States Patent [19]

Miller

[11] Patent Number: 5,165,429

[45] Date of Patent: Nov. 24, 1992

[54] HAIR CLAMP APPARATUS

[76] Inventor: Victoria A. Miller, 5077 Fairiew Rd., Hollister, Calif. 95023

[21] Appl. No.: 824,607

[22] Filed: Jan. 23, 1992

[51] Int. Cl.[5] ..... A45D 2/24

[52] U.S. Cl. ..... 132/263; 132/255; 132/264

[58] Field of Search ..... 132/245, 251, 252, 253, 132/254, 255, 256, 257, 258, 259, 260, 263, 264, 273, 279

[56] References Cited

U.S. PATENT DOCUMENTS

| | | | |
|---|---|---|---|
| 2,781,763 | 2/1957 | Casey et al. | 132/207 |
| 2,813,533 | 11/1957 | Fay | 132/279 |
| 2,977,960 | 4/1961 | Cattermole | 132/279 |

FOREIGN PATENT DOCUMENTS

| | | | |
|---|---|---|---|
| 0994202 | 8/1976 | Canada | 132/245 |
| 0954729 | 12/1956 | Fed. Rep. of Germany | 132/251 |
| 1189591 | 10/1959 | France | 132/251 |
| 2222973 | 10/1974 | France | 132/251 |
| 2481897 | 11/1981 | France | 132/278 |
| 2219741 | 12/1989 | United Kingdom | 132/273 |

*Primary Examiner*—Gene Mancene
*Assistant Examiner*—Frank A. LaViola
*Attorney, Agent, or Firm*—Leon Gilden

[57] ABSTRACT

A hair clamp structure is arranged for clamping a quantity of hair therewithin, wherein the clamp structure includes a plurality of pivotally mounted semi-cylindrical shells. The first shell includes a rib member projecting beyond a first shell second edge to be received within an inter-locking engagement with a second shell flange engaging beyond a second edge of the second shell. First edges of the first and second shells are of an interdigited construction including a hinge pin directed therethrough effecting pivotment of the first shell relative to the second shell. The upper and lower annular edges of each shell includes a semi-annular array of tooth members to enhance engagement of hair between the shells, with a lock pin to be received through openings of the shells' walls to effect locking and securement of the shells relative to a predetermined quantity of hair contained within the shells.

1 Claim, 4 Drawing Sheets

HAIR CLAMP APPARATUS

BACKGROUND OF THE INVENTION

1. Field of the Invention

The field of invention relates to hair control apparatus, and more particularly pertains to a new and improved hair clamp apparatus wherein the same is arranged to effect securement of hair therebetween to permit control of hair during a hair setting process, and particularly in the creation of a curling procedure to effect creation of "Zulu Curls".

2. Description of the Prior Art

In hair curling procedures, particular types of curls require securement of large quantities of hair relative to one another to effect proper treatment of the hair during a curling procedure. Prior art structure has heretofore not provided for adequate clamp sizing or of inappropriate materials that are undesirably reactive with hair curling chemicals. The instant invention attempts to overcome deficiencies of the prior art by providing for a polymeric clamp construction to permit engagement of large proportions of hair to permit application of various hair setting fluids thereto. Prior art curling structure for use in effecting creation of various waves is available in the prior art and exemplified in U.S. Pat. No. 3,768,492 to Scott utilizing various permanent wave rollers for use in a hair styling procedure.

U.S. Pat. No. 4,381,791 to Van Sickle sets forth a mandrel device for hair of a generally roller construction and a clamping spool relative to the roller for securement of hair.

The U.S. Pat. No. 4,470,423 to Wajaroff sets forth a process in the permanent waving of hair utilizing a particular solution.

U.S. Pat. No. 3,442,271 to Dangio sets forth a hair curler for creation of permanent waves.

As such, it may be appreciated that there continues to be a need for a new and improved hair clamp apparatus as set forth by the instant invention which addresses both the problems of ease of use as well as effectiveness in construction in the clamping of a predetermined quantity of hair in a hair setting procedure and in this respect, the present invention substantially fulfills this need.

SUMMARY OF THE INVENTION

In view of the foregoing disadvantages inherent in the known types of hair clamp apparatus now present in the prior art, the present invention provides a hair clamp apparatus wherein the same utilizes inter-engaging semi-cylindrical shells to secure large quantities of hair therewithin when in an inter-locking engagement relative to one another. As such, the general purpose of the present invention, which will be described subsequently in greater detail, is to provide a new and improved hair clamp apparatus which has all the advantages of the prior art hair clamp apparatus and none of the disadvantages.

To attain this, the present invention provides a hair clamp structure arranged for clamping a quantity of hair therewithin, wherein the clamp structure includes a plurality of pivotally mounted semi-cylindrical shells. The first shell includes a rib member projecting beyond a first shell second edge to be received within an interlocking engagement with a second shell flange engaging beyond a second edge of the second shell. First edges of the first and second shells are of an interdigited construction including a hinge pin directed therethrough effecting pivotment of the first shell relative to the second shell. The upper and lower annular edges of each shell includes a semi-annular array of tooth members to enhance engagement of hair between the shells, with a lock pin to be received through openings of the shell's walls to effect locking and securement of the shells relative to a predetermined quantity of hair contained within the shells.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair clamp apparatus which has all the advantages of the prior art hair clamp apparatus and none of the disadvantages.

It is another object of the present invention to provide a new and improved hair clamp apparatus which may be easily and efficiently manufactured and marketed.

It is a further object of the present invention to provide a new and improved hair clamp apparatus which is of a durable and reliable construction.

An even further object of the present invention is to provide a new and improved hair clamp apparatus which is susceptible of a low cost of manufacture with regard to both materials and labor, and which accordingly is then susceptible of low prices of sale to the consuming public, thereby making such hair clamp apparatus economically available to the buying public.

Still yet another object of the present invention is to provide a new and improved hair clamp apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
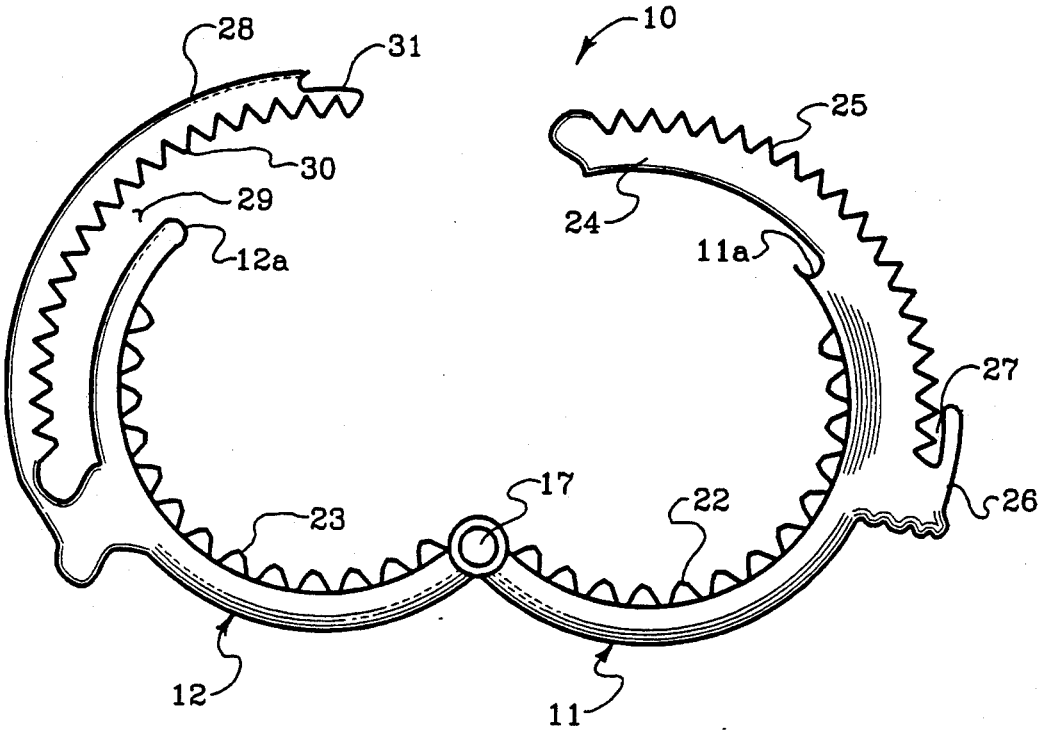
FIG. 1 is an orthographic end view of the clamp structure of the invention.
Figure 2:
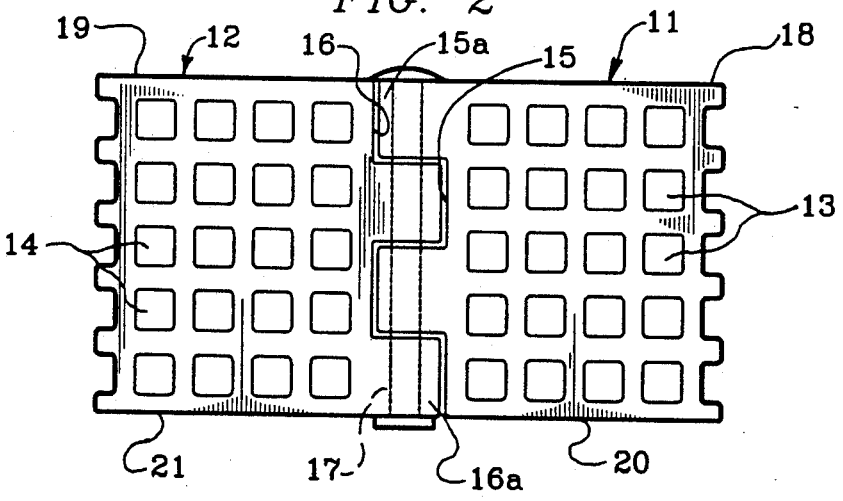
FIG. 2 is an orthographic bottom view of the clamp structure.
Figure 3:
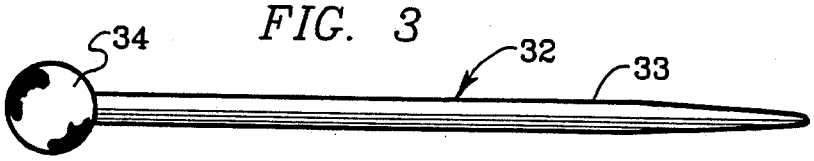
FIG. 3 is an orthographic view of a lock pin utilized by the invention.

With reference now to the drawings, and in particular to FIGS. 1 to 17 thereof, a new and improved hair clamp apparatus embodying the principles and concepts of the present invention and generally designated by the reference numeral 10 will be described.

Figure 4:
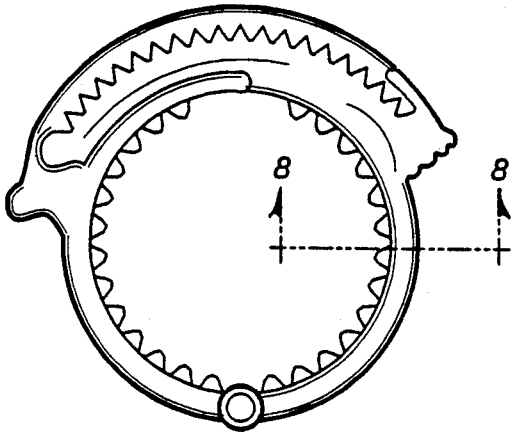
FIGS. 4, 5, 6, and 7 are orthographic end views of various sizes of clamp structure utilized by the invention.
Figure 8:
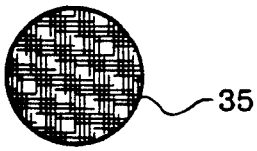
FIGS. 8, 9, 10, and 11 are cross-sectional illustrations, taken along the lines 8—8 of FIG. 4, 9—9 of FIG. 5, 10—10 of FIG. 6, and 11—11 of FIG. 7 respectively indicating various colorations utilized in the clamp structure.
Figure 5:
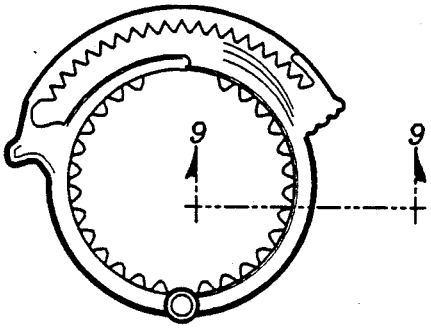
Figure 9:
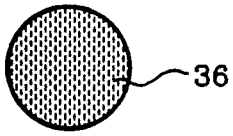
Figure 6:
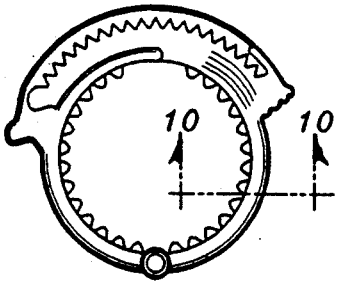
Figure 10:
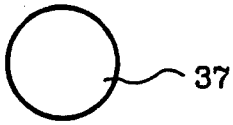
Figure 7:
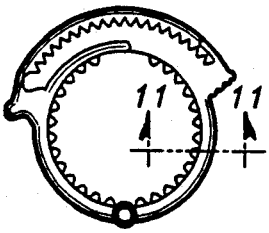
Figure 11:
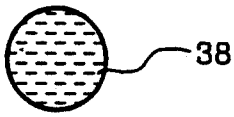

More specifically, the hair clamp apparatus 10 of the instant invention essentially comprises a first semi-cylindrical shell 11 hingedly mounted to a second semi-cylindrical shell 12 to define a clamping cylinder when in an inter-locked engagement relative to one another, such as illustrated in the FIG. 4. The first and second shells 11 and 12 are arranged in a coextensive relationship relative to one another, with the shells 11 and 12 including a matrix of respective first and second apertures 13 and 14 directed coextensively throughout the shells to enhance air flow through the shells when clamped about a quantity of hair, in a manner as illustrated in the FIG. 17. The first shell 11 includes a first shell digited first edge 15 interdigited with a digited second shell first edge 16. The shells include respective first and second projections 15*a* and 16*a* about the first and second edges 15 and 16, with a hinge pin 17 projecting through the projections 15*a* and 16*a* to effect a pivotment of the first shell 11 relative to the second shell 12. The hinge pin is arranged parallel to an axis of the first and second shell in construction.

A first shell upper annular edge 18 is coplanar with a second shell upper annular edge 19, with the first shell lower annular edge 20 coplanar with the second shell lower annular edge 21. The upper and lower edges of the first and second shells each include respective first and second tooth members 22 and 23 mounted fixedly to interior surfaces of the first and second shells 11 and 12, as the first and second tooth members 22 and 23 are radially oriented interiorly of each shell, in a manner as illustrated in the FIGS. 1 and 12 for example. The tooth members enhance engagement with a quantity of hair directed through the first and second shells when in a clamping cylinder arrangement, as illustrated in the FIG. 17.

A semi-cylindrical first rib 24 mounted to an exterior surface of the shell 11 extends annularly beyond a first shell second edge 11*a* and includes a semi-cylindrical rib array of teeth 25 mounted to an exterior surface of the semi-cylindrical rib 24. A flange member 26 mounted to the exterior surface of the second shell 12 is positioned beyond the second shell exterior surface and extends annularly forwardly of a second shell second edge 12*a*. A flange member 26 fixedly mounted adjacent a lower distal edge of the rib 24 is spaced above a predetermined proportion of the rib teeth 25 to define a first cavity 27. A second cavity 29 is arranged between the semi-cylindrical flange 28 and the second shell 12. Semi-cylindrical flange teeth 30 are mounted to a bottom surface of the semi-cylindrical flange 28 for cooperation with the semi-cylindrical rib teeth 25 of the semi-cylindrical rib 24 when the semi-cylindrical rib 24 is received within the second cavity 29 and a semi-cylindrical flange extension plate 31 mounted to a forward edge of the semi-cylindrical flange 28 is received within the first cavity 27 to effect secure inter-engagement of the first shell and the second shell together to provide for construction of a clamping cylinder.

Figure 12:
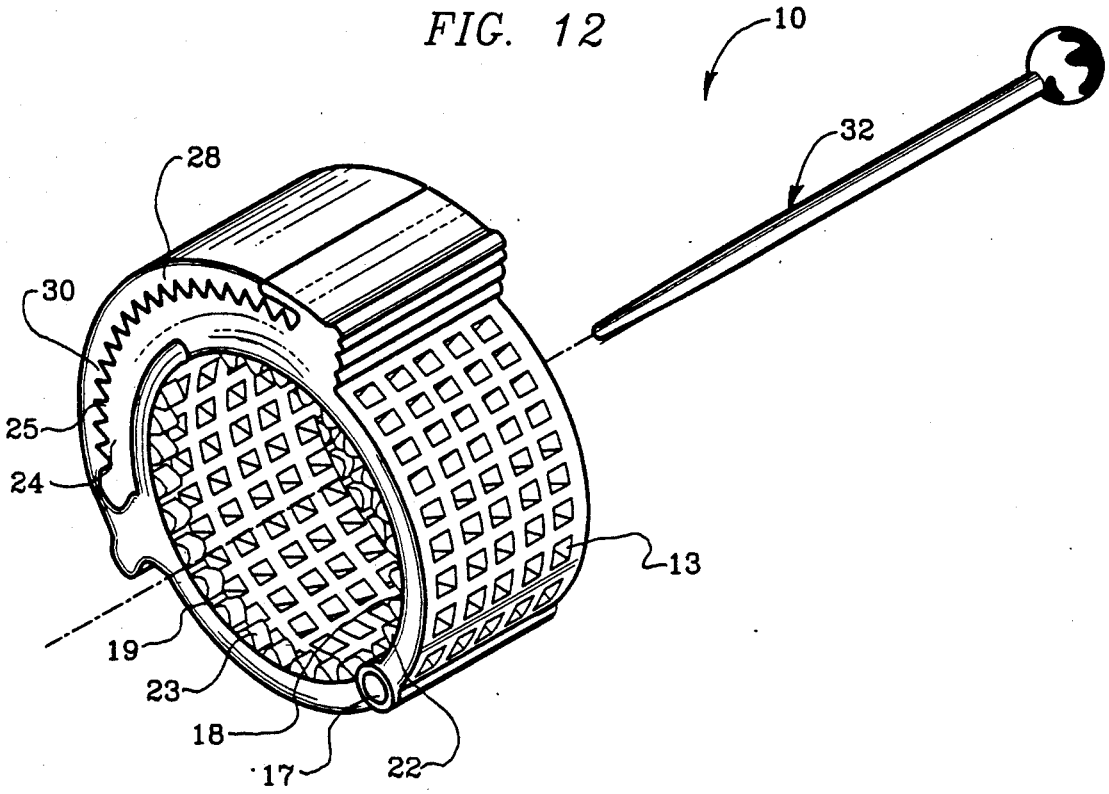
FIG. 12 is an isometric illustration of the invention.
Figure 17:
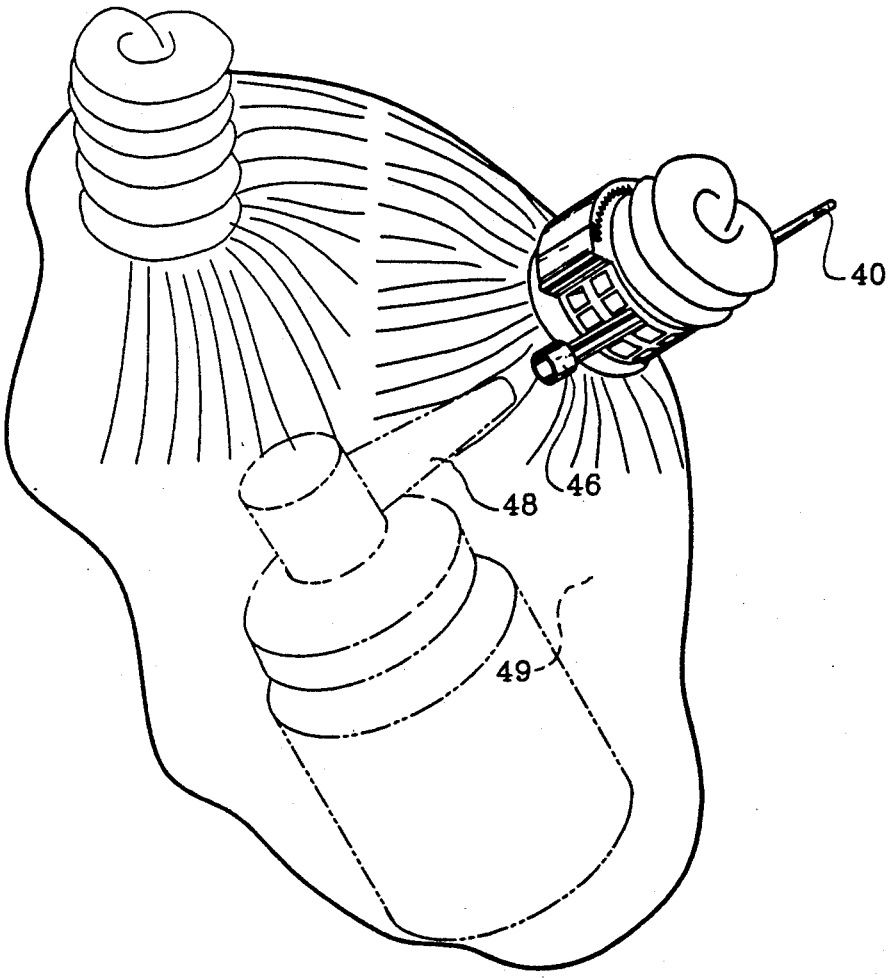
FIG. 17 is an isometric illustration of the invention in use.

A lock pin 32 is provided to include an elongate shank 33 formed with a head member 34 as the lock pin 32 is arranged for projection through the first and second apertures 13 and 14 to enhance positioning and securement of the clamping cylinder in position about a hair portion, in a manner as illustrated in the FIG. 17 and the FIG. 12. The FIGS. 4–7 inclusively and the FIGS. 8–11 inclusively illustrate various colorations and sizes that may be employed in contruction of the clamp apparatus of the invention.

Figure 13:
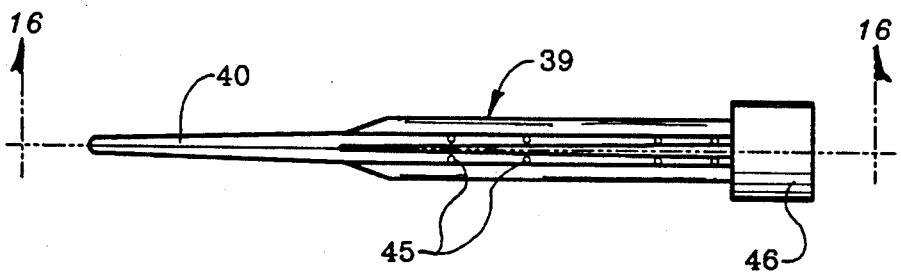
FIG. 13 is an orthographic view of a modified lock pin utilized by the invention.
Figure 14:
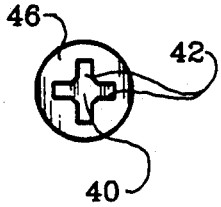
FIG. 14 is an orthographic forward end view of the invention.
Figure 15:
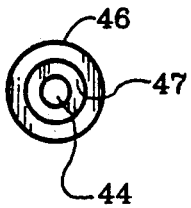
FIG. 15 is an orthographic rear end view of the invention.
Figure 16:
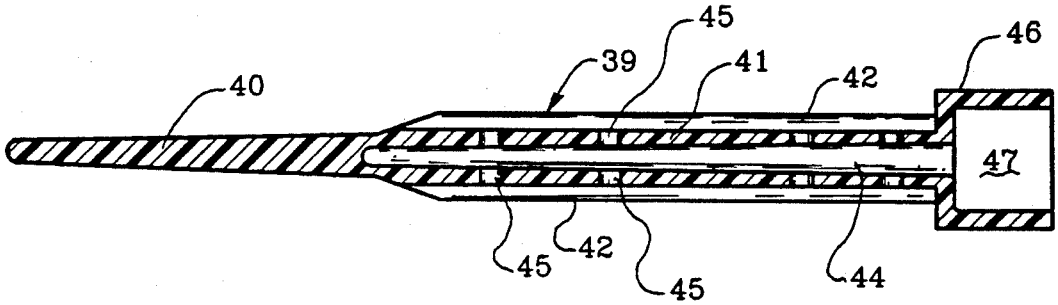
FIG. 16 is an orthographic view, taken along the lines 16—16 of FIG. 13 in the direction indicated by the arrows.

FIG. 13 includes a modified lock pin construction 39 formed with a forward solid shank 40 coaxially oriented relative to a rear tubular shank 41. The rear tubular shank 41 includes a plurality of projecting vanes oriented in a ninety degree spacing relative to one another radially projecting exteriorly of the rear tubular shank 41. The rear tubular shank 41 includes a tubular cavity 44 coextensive and coaxial therethrough, with tubular cavity ports 45 permitting communications exteriorly of the tubular cavity 44 and the rear tubular shank 41. A cylindrical head 46 is mounted to a rear distal end of the rear tubular shank 41 that includes a cylindrical head cavity 47 in communication with the tubular cavity 44 to receive a fluid nozzle 48 from the dispensing reservoir 49. In this manner, a hair setting fluid may be directed through the modified lock pin 39 and the respective cylindical head cavity 47, the tubular cavity 44, and ultimately the tubular cavity ports 45 for projection into hair contained within the clamp apparatus, in a manner as illustrated in FIG. 17, to receive fluid from the dispensing reservoir 49 and the associated fluid nozzle 48 whose free distal end is to be frictionally engaged within the cylindrical head cavity 47.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hair clamp apparatus, comprising, a first semi-cylindrical shell, with the first semi-cylindrical shell including a first digited first shell first edge, and including a first shell second edge, and a second semi-cylindrical shell including a digited second shell first edge spaced from a second shell second edge, wherein the first shell first edge and the second shell first edge are in inter-digited communication relative to one another, and the first shell first edge includes a plurality of first shell projections, and the second shell first edge includes a plurality of second shell projections positioned in adjacency relative to one another, with a hinge pin orthogonally projecting through the first shell first edge projections and the second shell first edge projections, and the first semi-cylindrical shell and the second semi-cylindrical shell arranged for contiguous communication of the first shell second edge and the second shell second edge to define a clamping cylinder, and the first semi-cylindrical shell and the second semi-cylindrical shell pivoted to a spaced relationship of the first shell second edge and the second shell second edge to permit reception of a predetermined quantity of hair therebetween, and the first shell includes a first upper annular edge and a first shell lower annular edge spaced from and parallel the first shell upper annular edge, and the second shell including a second shell upper annular edge spaced from and parallel a second shell lower annular edge, wherein the first shell upper annular edge and a second shell upper annular edge are coplanar and the first shell lower annular edge and a second shell lower annular edge are coplanar, and a plurality of first tooth members mounted to the first shell upper annular edge and the second shell upper annular edge, wherein the first tooth members project radially and interiorly of the first semi-cylindrical shell and the second semi-cylindrical shell, and a plurality of second tooth members mounted to the second shell lower annular edge and a first shell lower annular edge projecting radially and interiorly of the second semi-cylindrical shell and the first semi-cylindrical shell, and a semi-cylindrical rib mounted to an exterior surface of the first semi-cylindrical shell projecting annularly beyond the first shell second edge, and the semi-cylindrical rib including a flange member mounted fixedly to the semi-cylindrical rib adjacent the first end of the semi-cylindrical rib defining a first cavity, and a row of semi-cylindrical rib teeth mounted to an outer surface of the semi-cylindrical rib, and a semi-cylindrical flange mounted to an exterior surface of the second semi-cylindrical shell extending annularly beyond the second semi-cylindrical second edge and including a second cavity oriented between the semi-cylindrical flange and the second semi-cylindrical shell, and a row of semi-cylindrical flange teeth mounted to an interior surface of the semi-cylindrical flange projecting within the second cavity, with the semi-cylindrical rib teeth arranged for engagement with the semi-cylindrical flange teeth when the semi-cylindrical rib is received within the second cavity, and a semi-cylindrical flange plate projecting annularly beyond the semi-cylindrical flange for reception within the first cavity when the first semi-cylindrical shell second edge and the second edge and the second semi-cylindrical shell second edge are in contiguous communication relative to one another, and a lock pin, and the first semi-cylindrical shell includes a matrix of first apertures directed coextensively through the first semi-cylindrical shell, and the second semi-cylindrical shell includes a matrix of second apertures directed coextensively through the second semi-cylindrical shell, wherein the lock pin is arranged for reception through at least one of said first apertures and through at least one of said second apertures, and the lock pin includes a forward solid shank and a rear tubular shank, wherein the forward solid shank and the rear tubular shank are in coaxial alignment relative to one another, and the rear tubular shank includes a tubular cavity coextensive therewith, and a cylindrical head mounted to a rear distal end of the rear tubular shank, wherein the cylindrical head includes a cylindrical cavity in communication with the tubular cavity, and the tubular cavity includes a plurality of ports directed through the rear tubular shank in communication with the tubular cavity, and wherein the rear tubular shank further includes a plurality of projecting vanes projecting radially and exteriorly of the rear tubular shank, wherein the vanes are spaced apart ninety degrees relative to one another, and a fluid nozzle arranged for reception within the cylindrical head cavity to direct fluid through the cylindrical head cavity, the tubular cavity, and the tubular cavity ports, with the lock pin positioned within the first semi-cylindrical shell and the second semi-cylindrical shell.

* * * * *